United States Patent [19]

Yamato et al.

[11] Patent Number: 4,508,084

[45] Date of Patent: Apr. 2, 1985

[54] METHOD FOR CONTROLLING A FUEL METERING SYSTEM OF AN INTERNAL COMBUSTION ENGINE

[75] Inventors: Akihiro Yamato, Shiki; Akihiko Koike, Urawa, both of Japan

[73] Assignee: Honda Giken Kogyo Kabushiki Kaisha, Tokyo, Japan

[21] Appl. No.: 521,301

[22] Filed: Aug. 8, 1983

[30] Foreign Application Priority Data

Aug. 16, 1982 [JP] Japan ..... 57-141824

[51] Int. Cl.[3] ..... F02M 51/00

[52] U.S. Cl. ..... 123/492; 123/491

[58] Field of Search ..... 123/478, 493, 492, 480, 123/491

[56] References Cited

U.S. PATENT DOCUMENTS 4,239,022 12/1980 Drews et al. ..... 123/491
4,266,522 5/1981 Williams et al. ..... 123/492
4,326,488 4/1982 Herth et al. ..... 123/492
4,335,696 6/1982 Schnurle et al. ..... 123/492
4,359,991 11/1982 Stumpp et al. ..... 123/492
4,436,074 3/1984 Nakatsuka et al. ..... 123/492

*Primary Examiner*—Parshotam S. Lall
*Attorney, Agent, or Firm*—Pollock, Vande Sande and Priddy

[57] ABSTRACT

A method for controlling a fuel metering system of an internal combustion engine comprises a step for calculating at least a first increment control value indicative of an increment of fuel supply in accordance with an engine parameter and a second increment control value indicative of an increment of fuel supply in accordance with another engine parameter, and a step for comparing the first and second increment control values and selecting only the larger increment control value for the calculation of the quantity of fuel to be delivered to the engine, so as to prevent the superimposing of two increment control values which would produce an over rich air/fuel mixture.

5 Claims, 5 Drawing Figures

11
14
CPU
20
ROM
21
RAM
15
22
DRIVE CKT
10
FUEL INJECTOR
16
A/D CONVERTER
18
COUNTER
19
DIGITAL INPUT MODULE
17
MPX
24
WAVE-SHAPER
25
LEVEL CONVERTER CKT
23
LEVEL CONVERTER CKT
5
THROTTLE POSITION SENSOR
6
INTAKE AIR PRESSURE SENSOR
8
ENGINE COOLANT TEMPERATURE SENSOR
7
INTAKE AIR TEMPERATURE SENSOR
12
ATMOSPHERIC PRESSURE SENSOR
9
ENGINE SPEED SENSOR
13
STARTING MOTOR SWITCH

METHOD FOR CONTROLLING A FUEL METERING SYSTEM OF AN INTERNAL COMBUSTION ENGINE

BACKGROUND OF THE INVENTION

1. Field of the Invention

The present invention relates to a method for controlling a fuel metering system of an internal combustion engine, which system determines the quantity of the fuel to be delivered to the power cylinders of the engine.

2. Description of Background Information

In an electronic control system for a fuel metering system of an internal combustion engine, the quantity of fuel to be supplied to the engine power cylinder via a fuel supply means such as a carburetor or a fuel injector, is calculated in accordance with a plurality of parameters so as to optimize the engine operation under various conditions such as cold starting, acceleration, deceleration and so on. The method of calculation is such that the fundamental value of the quantity of fuel supply is first calculated in accordance with basic parameters such as the engine speed and the flow of the air drawn into the engine. In order to provide an accurate control, an increment or decrement correction value is further calculated in accordance with auxiliary parameters such as the engine coolant temperature and a sign indicative of the presence of a transitional state of the engine operation, and the thus calculated correction value is multiplied or added to the fundamental value in order to realize a desired control of the fuel supply.

In prior art, it was general to construct the control system so that a plurality of increment values or increment coefficients are independently calculated in response to each of the engine parameters depending on the state of the engine operation. Therefore, if two or more increment values are overlapped in some engine operational state, the total amount of the increment would become excessibly higher than an increment value actually needed. Such an excessive increase of the fuel supply would result in an over rich air-fuel mixture which deteriorates the engine performance and the fuel consumption characteristics and further it might cause an adverse effect upon the emission characteristics.

SUMMARY OF THE INVENTION

An object of the present invention is therefore to provide a method for controlling a fuel supply system of an internal combustion engine in which excessive increase of the quantity of the fuel supply, especially in a particular engine operational state, is prevented.

Another object of the present invention is to provide a method for controlling a fuel supply system which always provides very accurate control of the fuel metering system in various conditions of the engine operation.

According to the present invention, a method for controlling a fuel metering system of an internal combustion engine, comprises a sequence of calculation steps for calculating a quantity of fuel to be delivered to power cylinders of the engine in response to engine operating conditions determined in accordance with a plurality of parameters, including a first step for calculating a first value indicative of an increment of fuel supply responsive to one of the operating conditions, a second step for calculating a second value indicative of an increment of fuel supply responsive to another one of the operating conditions, and a step for comparing the first and second values and selecting the larger one of the first and second values for the calculation of the quantity of fuel.

According to another aspect of the present invention, the first value is indicative of the increment of fuel supply responsive to a parameter indicative of an engine temperature.

According to further aspect of the present invention, the second value is indicative of an increment of fuel supply responsive to a parameter indicative of an engine load condition.

According to still further aspect of the present invention, a method for controlling a fuel metering system of an internal combustion engine including a fuel delivering device, comprises a fundamental value calculating step for calculating a fundamental value for determining a fundamental quantity of fuel supply in accordance with a first parameter indicative of an engine speed and a second parameter indicative of an amount of air drawn into the engine, a first increment coefficient calculating step for calculating a first increment coefficient in response to a parameter indicative of an engine temperature, a second increment coefficient calculating step for calculating a second increment coefficient in response to a parameter indicative of an engine load, a comparison step for comparing the first and second increment coefficients and for selecting the larger one of the first and second increment coefficients, a control signal generating step for calculating a fuel supply control signal on the basis of a value obtained by multiplying the fundamental value with the selected increment coefficient, and a control step for controlling an operation of the fuel delivering device in accordance with the fuel supply control signal.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following description taken in conjunction with the accompanying drawings which are given by way of illustration only, and thus are not limitative of the present invention, and wherein.

DETAILED DESCRIPTION OF THE PREFERRED EMBODIMENTS

Figure 1:
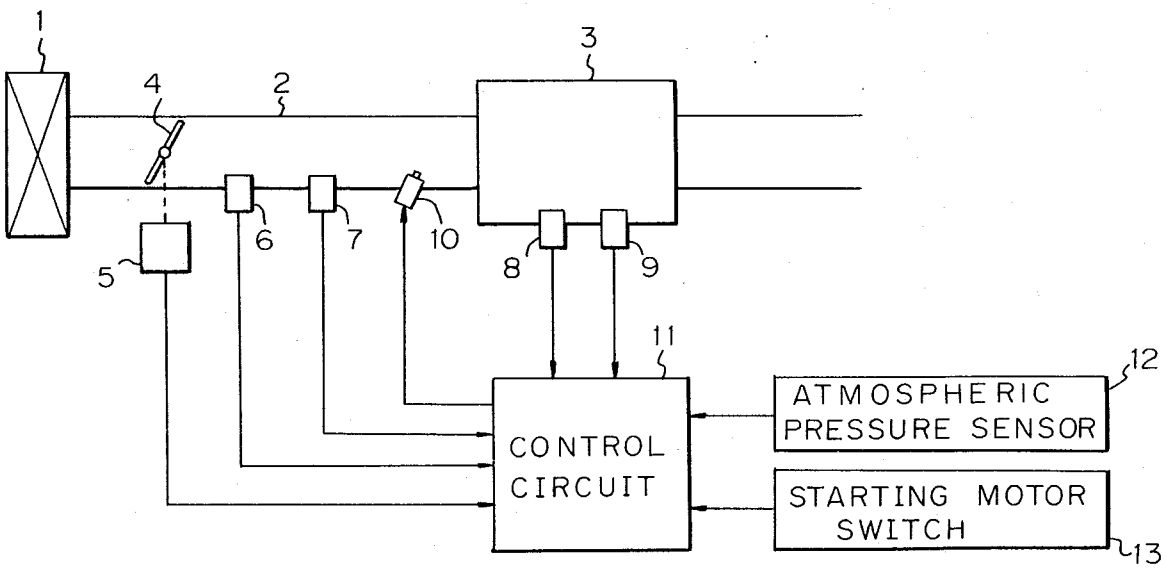
FIG. 1 is a diagram schematically illustrating an example of an electronically controlled fuel supply system of an internal combustion engine which can suitably be operated by the control method according to the present invention.

Reference is first made to FIG. 1, which is an example of an electronic control system for a fuel metering system of an internal combustion engine in which various sensors for sensing the engine operational parameters are mounted.

As shown in FIG. 1, an air intake system includes an air cleaner unit 1 mounted at an outer end of an air intake duct 2. The flow of the air taken at the air cleaner 1 and flowing through the air intake duct 2 is controlled by means of a throttle valve 4 and then sucked into cylinders 3 of an engine. In this air intake system, there are provided various sensors for generating signals indicative of values of various engine parameters to be applied to a control circuit 11. Firstly, a throttle position sensor 5 consisting of a potentiometer produces a throttle position signal whose voltage level is substantially proportional to the opening of the throttle valve 4. An intake air pressure sensor 6 senses an absolute value of the air pressure in a intake manifold downstream of the throttle valve and produces an output signal proportional to the sensed absolute value of the pressure. An intake air temperature sensor 7 produces an output signal indicative of the temperature of the intake air flowing through the intake manifold 2. An engine coolant temperature sensor 8 is provided on a cylinder block so as to detect the temperature of the engine coolant. Further, an engine speed sensor (crank angle sensor) 9 is provided to generate a pulse signal each time that the engine crankshaft is at a predetermined angular position. Output signals from these sensors 5 to 9 as well as a signal from an atmospheric pressure sensor 12 and a signal from a starting motor switch 13 are applied to the control circuit 11. The engine starting motor switch 13 produces its output signal when an engine starting motor is operated to start the engine. The control circuit 11 calculates the quantity of the fuel to be delivered to the engine cylinders in accordance with the output signals of these sensors and controls the operation of a fuel injector 10 which is also mounted in the intake manifold adjacent to the inlet ports of the engine cylinders.

Figure 2:
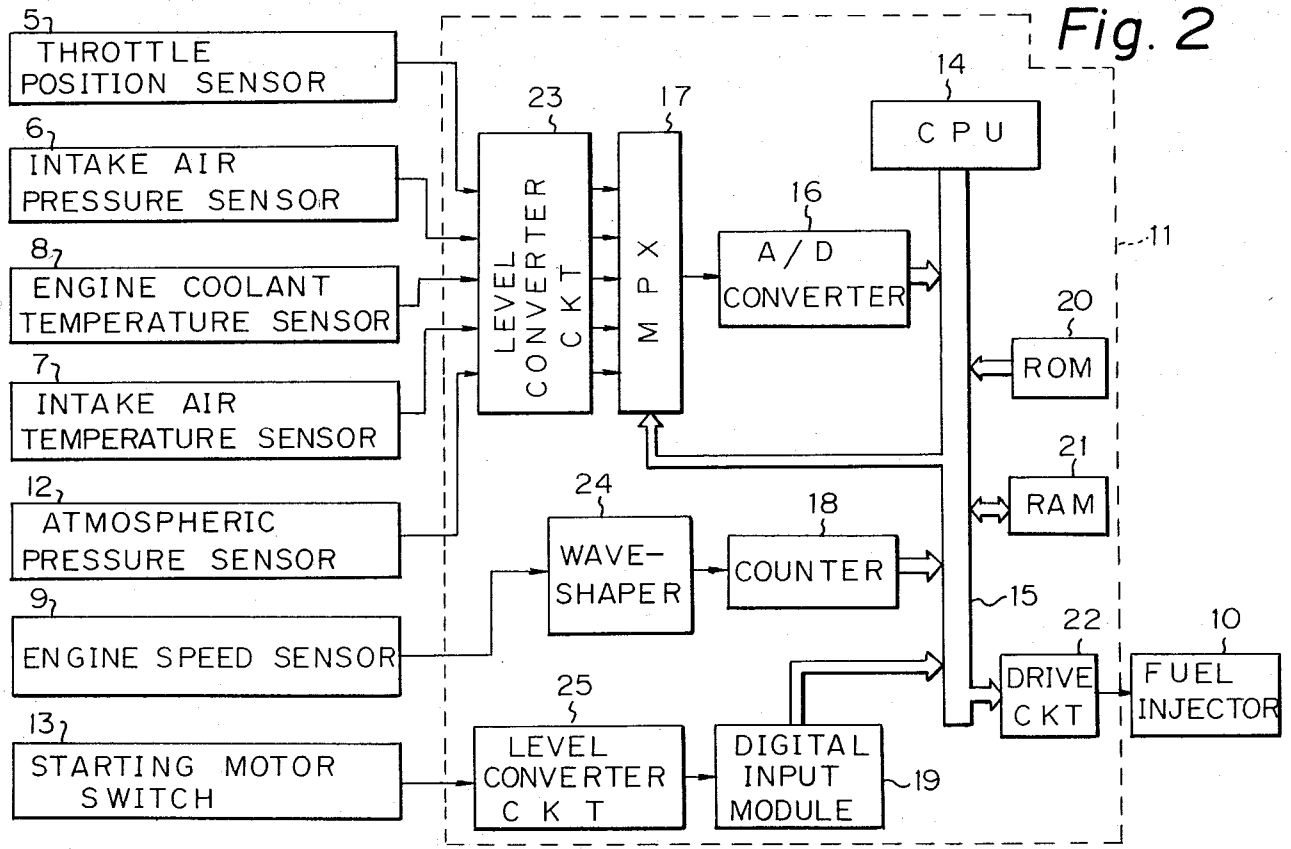
FIG. 2 is a block diagram showing the circuit construction of the fuel supply system of FIG. 1.

Referring to FIG. 2, the detailed construction of the control circuit 11 will be further explained hereinafter. The control circuit 11 includes a central processing unit (CPU) 14 which executes a digital calculation process in accordance with a program stored in a read only memory (ROM) 20. Data signals and address signals are transmitted into and from the CPU 14 via a bus 15 connected thereto. An analog to digital (A/D) converter 16, a multiplexer (MPX) 17, a counter 18, a digital input module 19, the read only memory (ROM) 20, a random access memory (RAM) 21 and a drive circuit 22 of the fuel injector 10 are connected to the bus 15.

The MPX 17 is a switch for selecting and transmitting, in accordance with a command from the CPU 14, one of the signals applied from a level converter circuit 23, which correspond to output signals of the sensors, that is, the throttle position sensor 5, the intake air pressure sensor 6, the intake air temperature sensor 7, the engine coolant temperature sensor 8 and the atmospheric pressure seneor 12. The counter 18 is connected, via a waveshaper 24, to an output terminal of the engine speed sensor 9 and detects the period of the generation of the output pulse signal of the engine speed sensor 9. The digital input module 19 is constructed to generate a digital output signal upon receipt of an input signal from a level converter circuit 25 when the starting motor switch 13 is turned on to drive a starting motor.

With this arrangement, the calculation of the quantity of fuel supply is performed by the CPU 14 in accordance with a program previously stored in the ROM 20. More specifically, the CPU 14 reads each of the data from the sensors 5 to 9 and 12 and switch 13 in an order given by the program and carries out the mathematical calculation of an injection time duration $T_{OUT}$ in accordance with a given equation in every predetermined number of rotations of the engine crankshaft. Consequently, the fuel injector 10 is opened for the predetermined time period in accordance with the result of the mathematical calculation. During the time period when the fuel injector is opened, the fuel is supplied to the power cylinders. The injection time duration $T_{OUT}$ in a base mode is calculated, for example, according to the following equation:

$$T_{OUT}=T_i\times K_1+T_{ACC}\times K_2+T_{AST}+T_V \quad (1)$$

in which $T_i$ is a fundamental injection time which is determined in accordance with the engine speed and either one of the absolute value of the pressure of the intake air and the quantity of the intake air, $T_{ACC}$ is an increment value for the period of acceleration, $T_{AST}$ is an increment value after the starting of the engine, $T_V$ is a correcting value in response to the voltage supplied to the injector 10, and $K_1$ and $K_2$ are correction coefficients.

The correction coefficient $K_1$ will be then calculated by the following equation (2):

$$K_1=K_{TW}\times K_{WOT}\times K_{TA}\times K_{PA}\times K_{AST}\times K_{AFC} \quad (2)$$

in which $K_{TW}$ is an increment coefficient for the cooling water temperature, $K_{WOT}$ is a full load increment coefficient for the period in which the throttle value is fully opened, KTA is a coefficient for the intake air temperature, KPA is a coefficient of the atmospheric pressure, $K_{AST}$ is a coefficient of increment after engine starting, and $K_{AFC}$ is a coefficient of increment after the fuel cut operation. These coefficients are respectively calculated by subroutines connected to the main routine of the calculation of the fuel injection time duration $T_{OUT}$ in the basic mode.

Figure 3:
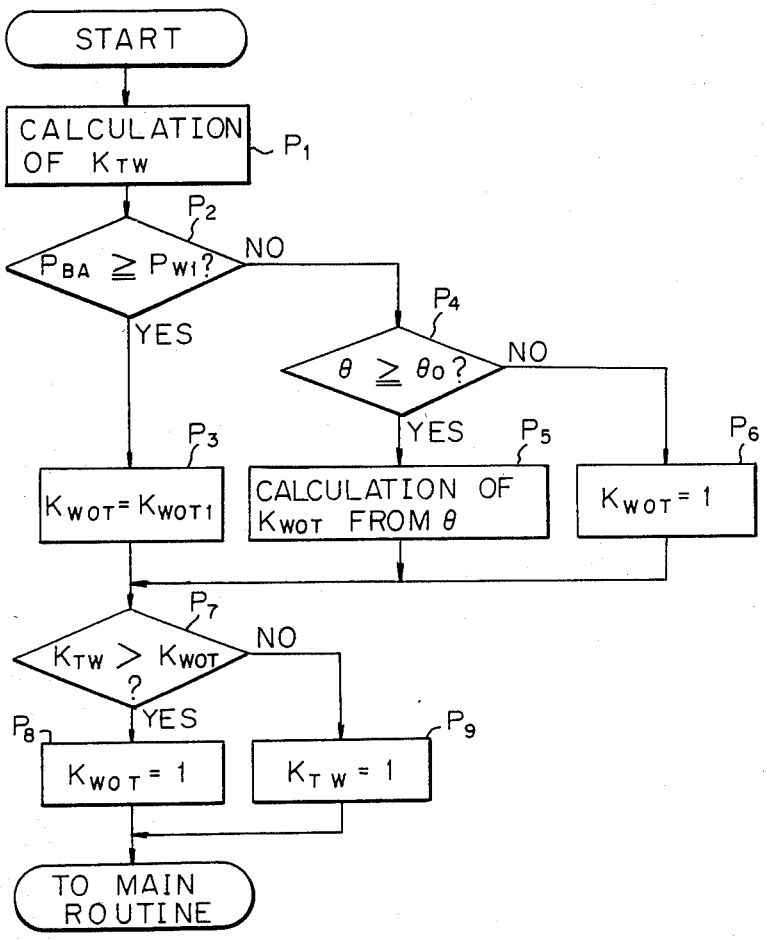
FIG. 3 is a flow chart showing the operational sequence according to the present invention.

The calculation of the cooling water temperature increment coefficient $K_{TW}$ and the full load increment coefficient $K_{WOT}$ will be explained with reference to a flow chart of the increment coefficient comparing subroutine shown in FIG. 3.

After the starting of the calculation process of the increment coefficients comparison subroutine, the CPU 14 calculates first the cooling water temperature increment coefficient $K_{TW}$ at a step $P_1$. The calculation of the cooling water temperature increment coefficient $K_{TW}$ is performed in accordance with the cooling water temperature $T_W$ and the absolute value of the intake air pressure. The value of the coefficient $K_{TW}$ decreases as the temperature of the cooling water increases, and increases as the absolute value of the intake air pressure increases.

Figure 4:
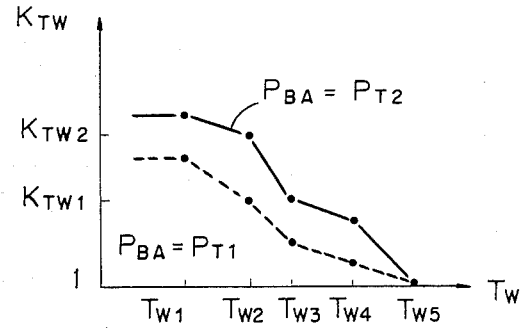
FIG. 4 is a diagram showing an example of a characteristic curve of a cooling water temperature increment coefficient used in the operational sequence shown in FIG. 3.

Two threshold curves which determine the cooling water temperature increment coefficient $K_{TW}$ are illustrated in FIG. 4 and are previously stored in ROM 20. The coefficient value is determined in a manner described as follows. If the absolute value of the intake air pressure $P_{BA}$ is lower than a predetermined reference value PT1 ($P_{BA} \leqq P_{T1}$), the coefficient value can be obtained from the lower one of the curves of FIG. 4, then a cooling water temperature coefficient $K_{TW}$ is fixed to a value $K_{TW1}$ for a measured value such as $T_{W2}$ of the coolant temperature $T_W$. On the contrary, if the absolute value of the intake air pressure $P_{BA}$ is higher than a predetermined reference value $P_{T2}$ that is higher than $P_{T1}$ ($P_{BA} \geqq P_{T2}$), the coefficient value can be obtained from the higher one of the curves, then the cooling water temperature increment coefficient value $K_{TW}$ is fixed to a higher value $K_{TW2}$ for the measured value of the coolant temperature. When the absolute value of the intake air pressure $P_{BA}$ is in between the values PT1 and PT2, then the cooling water temperature increment coefficient $K_{TW}$ is calculated by interpolation between the values $K_{TW1}$ and $K_{TW2}$ in response to the absolute value.

Figure 5:
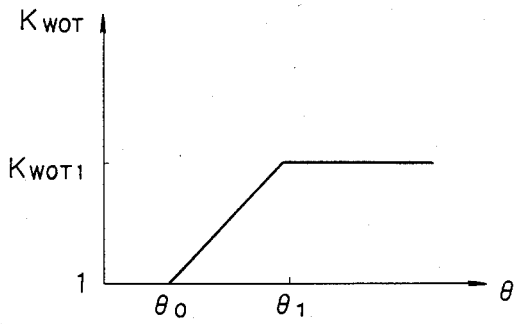
FIG. 5 is a diagram showing an example of a characteristic curve of a full load increment coefficient used in the operational sequence of FIG. 3.

After the calculation of the cooling water temperature increment coefficient $K_{TW}$, then the full load increment coefficient $K_{WOT}$ will be calculated in sequential steps $P_2$ through $P_6$. At the step $P_2$, the CPU 14 determines whether or not the absolute value of the intake air pressure $P_{BA}$ is higher than or equal to a predetermined reference value $P_{W1}$. If the absolute value $P_{BA}$ is higher than or equal to the reference value $P_{W1}$ ($P_{BA} \geqq P_{W1}$), then the full load increment coefficient $K_{WOT}$ is fixed to a predetermined value $K_{WOT1}$ at a step $P_3$. On the contrary, if the absolute value of the intake air pressure $P_{BA}$ is lower than the reference value $P_{W1}$ ($P_{BA} < P_{W1}$), then an opening degree $\theta$ of the throttle valve 4 is compared with a predetermined reference value $\theta_0$ at a step $P_4$. If the opening degree $\theta$ of the throttle valve 4 is greater than or equal to the reference opening value $\theta_0$ ($\theta \geqq \theta_0$), then the full load increment coefficient $K_{WOT}$ is calculated at a step $P_5$ by using the full load increment characteristic curve shown in FIG. 5, which coefficient is responsive to the opening degree $\theta$ of the throttle valve 4.

The full load increment coefficient characteristic curve is previously stored in the ROM 20. On the other hand, if the throttle opening degree $\theta$ is smaller than the reference value $\theta_0$ ($\theta < \theta_0$), the full load increment coefficient is fixed to a value of 1.0 at a step $P_6$.

After the cooling water temperature increment coefficient $K_{TW}$ and the full load increment coefficient $K_{WOT}$ have been thus calculated, these coefficient values are compared with each other at a step $P_7$. If the cooling water temperature increment coefficient $K_{TW}$ is larger than the full load increment coefficient $K_{WOT}$ ($K_{TW} > K_{WOT}$), the full load increment coefficient $K_{WOT}$ is fixed to 1 at a step $P_8$. However, if the cooling water temperature increment coefficient $K_{TW}$ is equal to or smaller than the full load increment coefficient $K_{WOT}$ ($K_{TW} \leqq K_{WOT}$), then the cooling water temperature increment coefficient $K_{TW}$ is fixed to 1 at a step $P_9$.

After passing through these steps, the fuel injection time period $T_{OUT}$ will be calculated, in the main routine of calculation of basic mode, by multiplying the basic injection time period $T_i$ with the selected one of the increment coefficients $K_{WOT}$ and $K_{TW}$.

As an example, in a case in which $K_{TW}$ is calculated to be 1.83, and $K_{WOT}$ is calculated to be 1.2 at the steps of $P_3$ or $P_5$, then the cooling water temperature increment coefficient $K_{TW}$ is detected to be larger than the full load increment coefficient $K_{WOT}$ at the step $P_7$, and therefore, the $K_{TW}$ and the $K_{WOT}$ will be fixed to the value 1.83 and 1 respectively. As the result, the increment correction time duration 0.83 $T_i$ is added to the fundamental value of the injection time duration $T_i$. This means that no increment correction corresponding to the full load increment coefficient $K_{WOT}$ which has been calculated at the step $P_3$ or at the step $P_5$ will be added to the fundamental value of the injection time duration $T_i$.

It will be appreciated from the foregoing, that according to the present invention, the fuel injection time duration is calculated by multiplying the fundamental value of the fuel supply with only the larger one of at least two increment correction coefficients. Thus, the superimposition of a plurality of increment correction coefficients derived from each of the engine parameters, which would result in an excessive supply of the fuel, is eliminated. Therefore, the deterioration of the drivability and the fuel consumption characteristics and moreover the adverse effect to the emission characteristics which would be caused by the over rich state of the air to fuel mixture, are eliminated by the control method according to the present invention.

It should be understood that the foregoing description is for illustrative purpose only, and is not intended to limit the scope of the invention. Rather, there are numerous equivalents to the preferred embodiment, and such are intended to be covered by the appended claims. As an example, though the cooling water temperature increment coefficient $K_{TW}$ and the full load increment coefficient $K_{WOT}$ are compared in the preferred embodiment, the method may be modified to compare the other increment coefficients such as the coefficient of increment after engine starting $K_{AST}$ and the coefficient of increment after the fuel cut operation $K_{AFC}$.

What is claimed is:

1. A method for controlling a fuel metering system of an internal combustion engine, comprising a sequence of calculation steps for calculating a quantity of fuel to be delivered to power cylinders of said engine in response to engine operating conditions determined in accordance with a plurality of parameters, including a first step for calculating a first value indicative of an increment of fuel supply responsive to one of said operating conditions, a second step for calculating a second value indicative of an increment of fuel supply responsive to another one of said operating conditions, and a step for comparing said first and second values and selecting the larger one of said first and second values for said calculation of the quantity of fuel.

2. A method as set forth in claim 1, wherein said first value is indicative of the increment of fuel supply responsive to a parameter indicative of an engine temperature.

3. A method as set forth in claim 2, wherein said second value is indicative of an increment of fuel supply responsive to a parameter indicative of an engine load condition.

4. A method as set forth in claim 1, wherein said second value is indicative of an increment of fuel supply responsive to a parameter indicative of an engine load condition.

5. A method for controlling a fuel metering system of an internal combustion engine including a fuel delivering device, comprising steps of:

a fundamental value calculating step for calculating a fundamental value for determining a fundamental quantity of fuel supply in accordance with a first parameter indicative of an engine speed and a second parameter indicative of an amount of air drawn into the engine;

a first increment coefficient calculating step for calculating a first increment coefficient in response to a parameter indicative of an engine temperature;

a second increment coefficient calculating step for calculating a second increment coefficient in response to a parameter indicative of an engine load;

a comparison for comparing said first and second increment coefficients and for selecting the larger one of said first and second increment coefficients;

a control signal generating step for calculating a fuel supply control signal on the basis of a value obtained by multiplying said fundamental value with said selected increment coefficient; and a control step for controlling an operation of said fuel delivering device in accordance with said fuel supply control signal.

* * * * *